US012751540B2

(12) United States Patent
Cole et al.

(10) Patent No.: US 12,751,540 B2
(45) **Date of Patent: *Oct. 6, 2026**

(54) LIGHT WEIGHT MODULAR POUCH ATTACHMENT SYSTEM AND METHOD

(71) Applicant: FirstSpear Technology Group, LLC, Fenton, MO (US)

(72) Inventors: Michael E. Cole, Ste. Genevieve, MO (US); Brian Rapp, Millstadt, IL (US)

(73) Assignee: FirstSpear Technology Group, LLC, Fenton, MO (US)

( * ) Notice: Subject to any disclaimer, the term of this patent is extended or adjusted under 35 U.S.C. 154(b) by 844 days.

This patent is subject to a terminal disclaimer.

(21) Appl. No.: 17/982,090

(22) Filed: Nov. 7, 2022

(65) Prior Publication Data

US 2023/0053906 A1 Feb. 23, 2023

Related U.S. Application Data

(60) Division of application No. 17/146,092, filed on Jan. 11, 2021, now Pat. No. 11,490,719, which is a division of application No. 16/669,462, filed on Oct. 30, 2019, now Pat. No. 10,888,150, which is a continuation-in-part of application No. 15/985,215, (Continued)

(51) Int. Cl.

| | |
|---|---|
| ***A45F 5/02*** | (2006.01) |
| ***A44B 18/00*** | (2006.01) |
| ***A45F 3/00*** | (2006.01) |
| ***A45F 3/14*** | (2006.01) |
| ***F42B 39/02*** | (2006.01) |
| *A45C 13/30* | (2006.01) |

(52) U.S. Cl.

CPC ..... *A45F 5/02* (2013.01); *A44B 18/00* (2013.01); *A44B 18/0073* (2013.01); *A45F 3/00* (2013.01); *A45F 3/14* (2013.01); *A45F 5/021* (2013.01); *F42B 39/02* (2013.01); *A45C 13/30* (2013.01); *A45C 2013/306* (2013.01); *A45F 2003/001* (2013.01); *A45F 2003/146* (2013.01); *Y10T 24/13* (2015.01); *Y10T 24/1382* (2015.01)

(58) Field of Classification Search

CPC ..... A45F 5/02; A45F 3/00; A45F 2200/0508; A45F 2200/0516; A45F 2200/0566; Y10S 224/931; Y10S 224/914; F42B 39/02

See application file for complete search history.

(56) References Cited

U.S. PATENT DOCUMENTS 3,212,689 A * 10/1965 Woolfolk ..... F42B 39/02 206/3

4,458,133 A 7/1984 Macken (Continued)

*Primary Examiner* — Corey N Skurdal

(74) *Attorney, Agent, or Firm* — Matthews Edwards LLC

(57) ABSTRACT

A 3 dimensional shape retaining light weight pouch and method for making the same, for mounting on a carrier such as a garment such as, but not limited to, a vest, belt, cummerbund, pack, or the like, and more particularly, that utilizes standing portions of stiffened fused together edges of laminated or composite panels of the pouch to hold the pouch in a predetermined 3 dimensional shape. The pouch is durable and wear resistant, allows easy insertion and removal of articles, accessories, and objects to be held and/or carried thereby, and is simple and easy to manufacture, while being configurable to be compatible with some known systems mounting systems such as MOLLE PALS and the like.

23 Claims, 10 Drawing Sheets

Related U.S. Application Data filed on May 21, 2018, now Pat. No. 10,905,226, which is a division of application No. 15/431,377, filed on Feb. 13, 2017, now Pat. No. 9,974,379, which is a division of application No. 14/237,468, filed on Feb. 6, 2014, now Pat. No. 9,565,922.

(56) References Cited

U.S. PATENT DOCUMENTS 5,152,442 A * 10/1992 Gallagher ..... A45F 5/02 206/3
5,174,482 A * 12/1992 Rogers ..... F42B 39/02 221/185
5,351,868 A * 10/1994 Beletsky ..... A45C 11/00 224/245
5,392,975 A * 2/1995 Blankenship, Jr. ..... B05B 9/08 206/317
5,965,223 A 10/1999 Andrews et al.
6,202,908 B1 * 3/2001 Groover ..... F42B 39/02 224/236
6,218,017 B1 * 4/2001 Yamashita ..... B32B 9/00 428/424.2
6,568,576 B1 5/2003 Godshaw et al.
6,722,695 B2 4/2004 Kobayashi et al.
7,918,371 B2 * 4/2011 Wilson ..... F41A 9/65 224/196
10,470,508 B2 * 11/2019 O'Connor ..... A45C 11/00
2002/0134809 A1 * 9/2002 Angus ..... A45F 3/00 224/662
2005/0273064 A1 * 12/2005 Dircks ..... B32B 7/12 604/322

* cited by examiner

LIGHT WEIGHT MODULAR POUCH ATTACHMENT SYSTEM AND METHOD

This application claims priority to U.S. Provisional Application Ser. No. 62/753,064, filed Oct. 30, 2018, and is a division of co-pending divisional U.S. patent application Ser. No. 17/146,092, filed Jan. 11, 2021, which will issue on Nov. 8, 2022 as U.S. Pat. No. 11,490,719, which is a division of continuation-in-part U.S. patent application Ser. No. 16/669,462, filed Oct. 30, 2019, which issued on Jan. 12, 2021 as U.S. Pat. No. 10,888,150, which application is a continuation-in-part of divisional U.S. patent application Ser. No. 15/985,215, filed May 21, 2018, which is a division of U.S. patent application Ser. No. 15/431,377, filed Feb. 13, 2017, which issued on May 22, 2018 as U.S. Pat. No. 9,974,379, which application is a division of U.S. patent application Ser. No. 14/237,468, filed Feb. 6, 2014, which issued on Feb. 14, 2017 as U.S. Pat. No. 9,565,922, which was submitted under 35 U.S.C. 371 claiming priority to PCT/US2012/50001, filed Aug. 8, 2012, claiming the benefit of U.S. Provisional Application No. 61/521,309, filed Aug. 8, 2011.

TECHNICAL FIELD

The present invention relates generally to a 3 dimensional shape retaining light weight pouch and method for making the same, for mounting on a carrier such as a garment such as, but not limited to, a vest, belt, cummerbund, pack, or the like, and more particularly, that is strong, resiliently retains a predetermined 3 dimensional shape, is durable and wear resistant, allows easy insertion and removal of articles, accessories, and objects to be held and/or carried thereby, and is simple and easy to manufacture, while being configurable to be compatible with some known systems mounting systems such as MOLLE PALS and the like.

BACKGROUND ART

The disclosures of U.S. Provisional Application Ser. No. 62/753,064, filed Oct. 30, 2018, division U.S. patent application Ser. No. 17/146,092, filed Jan. 11, 2021, now U.S. Pat. No. 11,490,719, issued Nov. 8, 2022, continuation-in-part U.S. patent application Ser. No. 16/669,462, filed Oct. 30, 2019, now U.S. Pat. No. 10,888,150, dated Jan. 12, 2021, division U.S. patent application Ser. No. 15/985,215, filed May 21, 2018, division U.S. patent application Ser. No. 15/431,377, filed Feb. 13, 2017, now U.S. Pat. No. 9,974,379, dated May 22, 2018, division patent application Ser. No. 14/237,468, filed Feb. 6, 2014, now U.S. Pat. No. 9,565,922, issued Feb. 14, 2017, PCT application Serial No. PCT/US2012/50001, filed Aug. 8, 2012, and U.S. Provisional Application No. 61/521,309, filed Aug. 8, 2011, are hereby incorporated herein in their entirety by reference.

Modular pouch attachment systems and methods for carrier garments, hereinafter sometimes referred to by the term carrier or carriers, such as, but not limited to, vests, cummerbunds, belts, and the like, for carrying holders such as, but not limited to, pouches for holding items and accessories on a person's body, are well known. Advantages include an ability to attach pouches and accessories to a platform and easily remove them; rearrange or configure them; and exchange for other pouches or accessories.

Reference, Kirk et al., U.S. Pat. No. 5,724,707, issued on Mar. 10, 1998; and Johnson, U.S. Pat. No. 7,047,570, issued on May 23, 2006, which show representative commercially available pouch attachment systems and methods, commonly referred to as MOLLE PALS. Typically, such known systems utilize one or more elongate woven webs or straps, sewn or otherwise affixed at longitudinally spaced locations to a panel comprising fabric layers, forming a side by side pattern of loops. If multiple webs or straps are used, they are laterally spaced apart, e.g., vertically, so as to extend horizontally across a surface of the garment or other device, at vertically spaced intervals, such that the loops of the webs will be vertically aligned. A pouch or other accessory will include one or more elongate straps configured to be inserted through the aligned loops. The straps will typically each be attached at one end to the pouch or accessory, and have an opposite free end. The back side of the pouch or other accessory will typically include additional loops positioned to be disposed in alternating relation to the loops on the panel, such that the straps can be alternatingly woven through the loops on the panel and the back of the pouch or accessory, for attaching the pouch or accessory to the panel. The free end of the attachment straps can then be secured, using a snap, hook and loop fastener, or other fastener or retainer, to the back of the pouch or accessory. Numerous compatible attachment devices have been developed for use with the MOLLE PALS system, including a variety of light weight but strong plastic clips.

Recent years have seen increased demand to further reduce the overall weight of the systems for carrying the various articles and accessories, which has led to development of improved attachment systems, such as disclosed in related patents: Cole et al., U.S. Pat. No. 9,565,922 B2, issued on Feb. 14, 2017; and Cole et al., U.S. Pat. No. 9,974,379 B2, issued on May 22, 2018, both of which being hereby incorporated herein in their entireties by reference, and that are lighter weight, yet equally strong as earlier known attachment systems.

Pouches and pockets (herein sometimes commonly referred to by the term "pouch") for use with the above referenced modern and older carrier and attachment systems still have significant shortcomings, for instance, the tendency to lose their shape when the article or accessory is not located therein. In particular in this latter regard, it is often advantageous and/or desired that pouches and pockets have an opening in communication with an interior cavity or cavities for receiving and holding an item or items, article or articles, through which the item(s) or article(s) are inserted, that will retain a particular shape, e.g., a rectangular or arched shape, which will usually at least generally corresponding to an overall sectional or profile shape of the item(s) or article(s) to be received. Use of products such as basting tape, reinforcing stitching, and the like, around peripheral edges helps to retain the shape of openings, but can become an impediment to rapid free insertion and removal of articles and accessories, and the basting tape and associated stitching, as well as stitching when used alone, have been found to suffer from premature wear, including partial detachment from the pouch and unraveling, leading to fraying and other problems. Basting tape and stitching are also labor intensive aspects of manufacturing textile products such as pouches, as they require acquiring, patterning, cutting, emplacing, and stitching additional material. Still further, basting tape, stitching, and other protrusions, even slight, can collect moisture and debris such as sand, mud, dirt, and the like which can be released into cavities, recesses, etc., of articles during insertion and/or removal, so as to potentially disrupt or interfere with operation thereof.

As an alternative, or in addition to basting, reinforcing stitching, etc., a stiffening layer or panel, liner, or thicker, or stiffer material can be utilized for 3 dimensional shape retention, but adds weight and complexity, and can become detached so as to lose the desired shape and impede insertion/removal of items and articles into/from the pouch.

As an observation, when basting tape, reinforcing stitching, and/or stiffening panels are used to impart or hold a 3 dimensional shape, individually and collectively they generally lacks a resilient property, so as to be potentially lose the desired 3 dimensional shape when compressed.

Accordingly, what is sought are reduction in weight, improvement in shape retention, operability and durability, and simplification and reduction in cost of manufacture, of a variety of pouches and pockets, as well as other advantages.

SUMMARY OF THE INVENTION

What is disclosed is a pouch or pocket for mounting or attaching to carrier garments such as, but not limited to, vests, cummerbunds, belts, shirts, jackets, pants, packs, and the like, that is light weight, strong, durable, resiliently retains a desired three dimensional shape when empty and when receiving articles, and is simple and easy and economical to manufacture, is durable and wear resistant, and can be compatible with a variety of known mounting and attachment systems such as MOLLE PALS and the like, and otherwise overcomes one or more of the shortcomings and limitations set forth above.

According to aspects of the invention, the pouch includes a unitary or integral pouch enclosure panel of a flexible laminate or composite construction, having a smooth inner surface bounding a pouch cavity, and an outer surface. The pouch enclosure panel has a center region bounded by a periphery comprising multiple spaced apart connecting portions angularly related to the center region and to each other, connecting the pouch enclosure panel to a base, platform, backing member, or other support structure of the pouch. The pouch enclosure panel has a plurality of standing portions integral with and disposed between the connecting portions and which can define and bound gaps therebetween, the standing portions resiliently standing outwardly from the platform, back panel, or backing member of the pouch, to hold the pouch enclosure panel in a 3 dimensional shape with the center region in spaced, opposing relation the platform, back panel, or backing member, to define and bound a pouch cavity therebetween for receiving articles, accessories and other items.

According to another aspect of the invention, the standing portions comprise integral, elongate peripheral edges of the connecting portions, and at least one integral peripheral edge of the center region extending between predetermined ones of the connecting portions to define and bound an opening or openings connecting to the pouch cavity and through which an article, accessory or other item is received and removed from the pouch cavity.

According to a preferred aspect of the invention, the standing portions each comprise stiffened fused edges of the layers of the laminate or constituent components of the composite, that is edges of layers of the laminate or composite fused together along their co-extending lengths so as to be stiffened sufficiently, e.g., self or free standing, to hold the pouch enclosure panel in the 3 dimensional shape in connection with the base, platform, backing member, or other support structure of the pouch, to allow insertion of an article or accessory through the opening into the pouch cavity and removal therefrom without having to manually open and/or hold the pouch open.

As another preferred aspect of the invention, at least the standing portion or portions that define and bound the opening or openings and an adjacent region of the pouch enclosure panel are sufficiently resiliently flexible to allow the pouch enclosure panel to be pressed using moderate manual pressure when the pouch is empty, from its free standing 3 dimensional shape, to a shape fully or partially compacted against the base, and automatically return to the free standing 3 dimensional shape when the pressure is removed. As non-limiting examples the standing portions can be configured in a bowed shape, arched shape, hoop shape, hairpin shape, or otherwise configured to hold the pouch and the opening in the 3 dimensional shape, which, as non-limiting examples, can comprise a rectangular, square, or other polygonal profile shape, or a rounded or oval profile shape, or combinations of shapes, as desired or required for a particular application.

Essentially in this regard, by being cohesively fused together the edges of the laminated layers or composite components comprising the standing portions act as stiffeners integrated into the edges of the pouch enclosure panel to hold it in the 3 dimensional shape without significantly protruding therefrom in a manner so as to interfere with or obstruct passage of an article or accessory into or from the opening. That is, at least the standing portion bounding the opening faces outward thereabout and is preferably smooth—it has no steps, shoulders, or protrusions facing the cavity sufficiently obstructive to impede movements of, or to catch on, an article or accessory being inserted into or removed from the cavity, or that will retain contaminants such as dirt, sand, and the like to any significant extent.

According to another preferred aspect of the invention, the fused together edges of the laminated layers comprise at least two layers of the laminate, e.g., outer layer and an inner layer; or a substrate, e.g., fabric layer or layers, and an impregnating resin component of a composite, forming an integral or unitary edge structure that is adequately stiffened by the fusion to hold the respective standing portion in a predetermined shape and orientation in relation to an associated base or platform of the pouch, to define the pouch and opening shapes. The shape of the opening can be 2 or 3 dimensional, the overall shape of the pouch enclosure panel being 3 dimensional.

According to another preferred aspect of the invention, the fused together edges of the laminated layers comprising at least the standing portion bounding the opening or openings are hardened by the fusion so as to have increased wear resistant and other advantageous properties. The stiffened standing portions can optionally have sufficient resilient flexibility to allow the pouch enclosure panel to be flexed or bent into the 3 dimensional shape, or to be conformed and snugged about an article, accessory, item, etc., held in the pouch, including, but not limited to, an item extending through the opening, e.g., an ammunition magazine, radio, tool, container, etc.

According to another preferred aspect of the invention, the pouch can comprise one or more additional pouch enclosure panels connected in stacked or side by side relation.

DETAILED DESCRIPTION OF PREFERRED EMBODIMENTS

Figure 1:
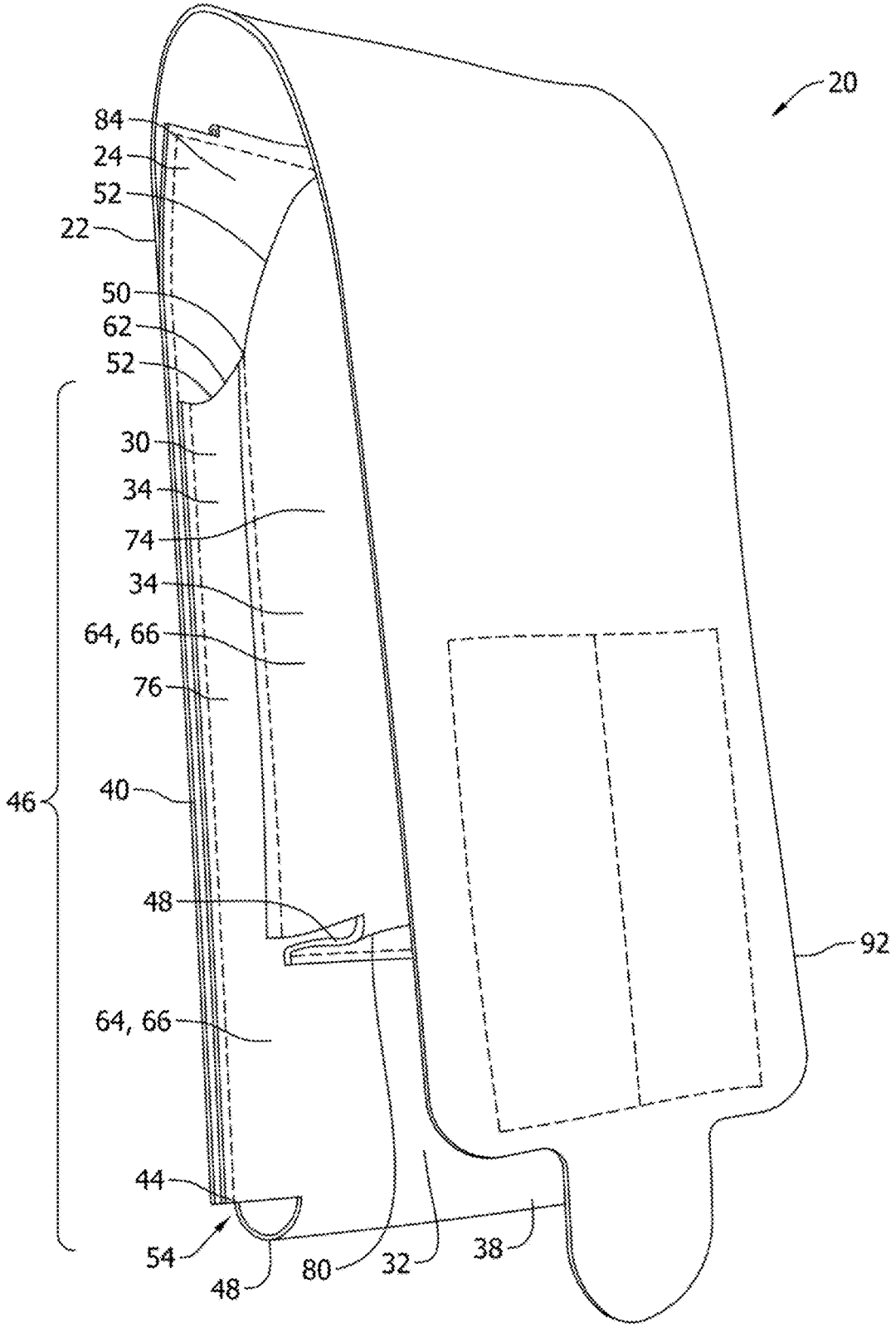
FIG. 1 is a perspective view of one embodiment of a pouch of the invention, showing an optional cover over openings of the pouch.
Figure 2:
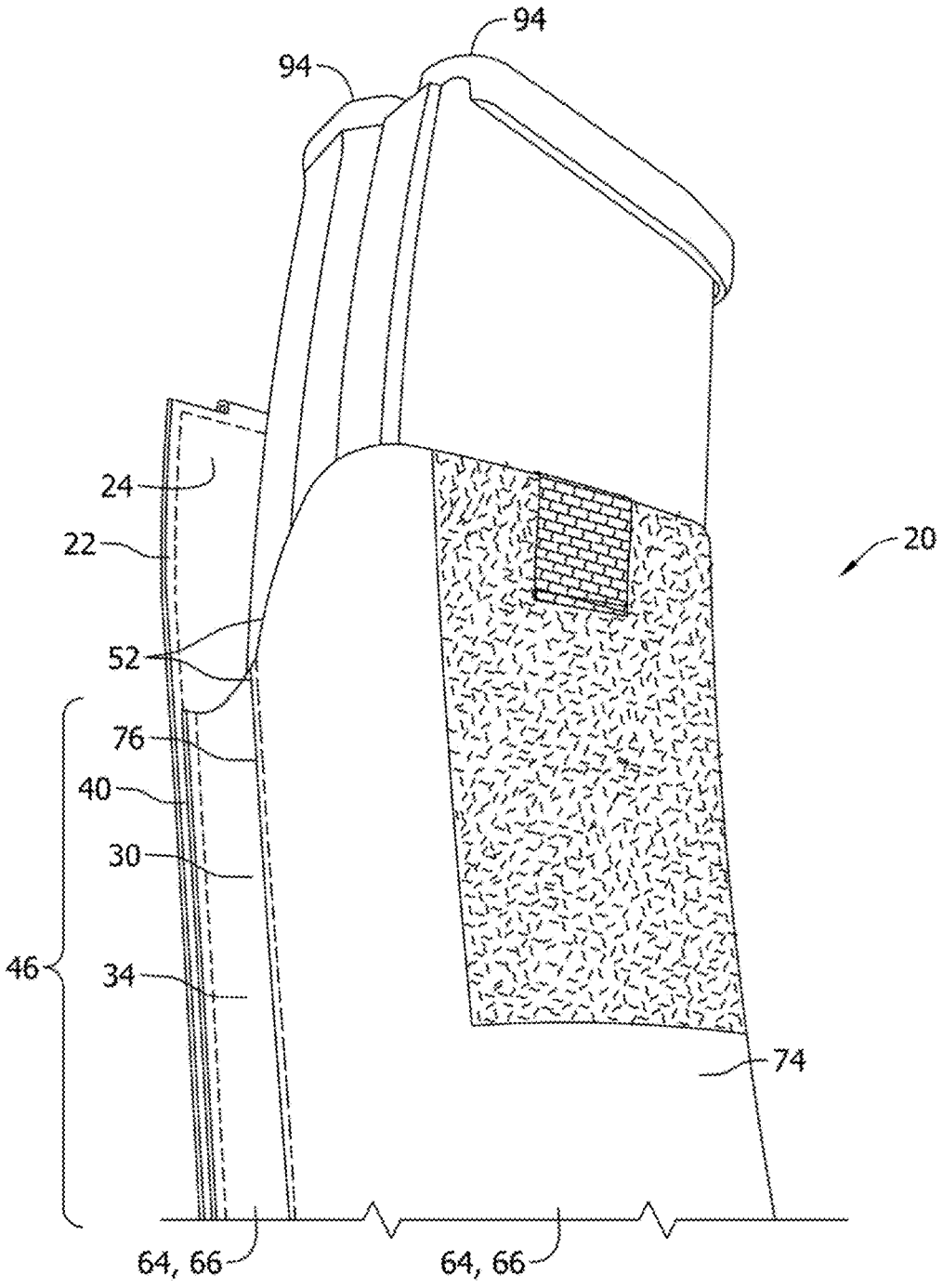
FIG. 2 is an enlarged perspective view of the pouch of FIG. 1, showing the cover removed and articles which are representative ammunition magazines, disposed in cavities of the pouch and extending through openings in connection with the cavities.
Figure 3:
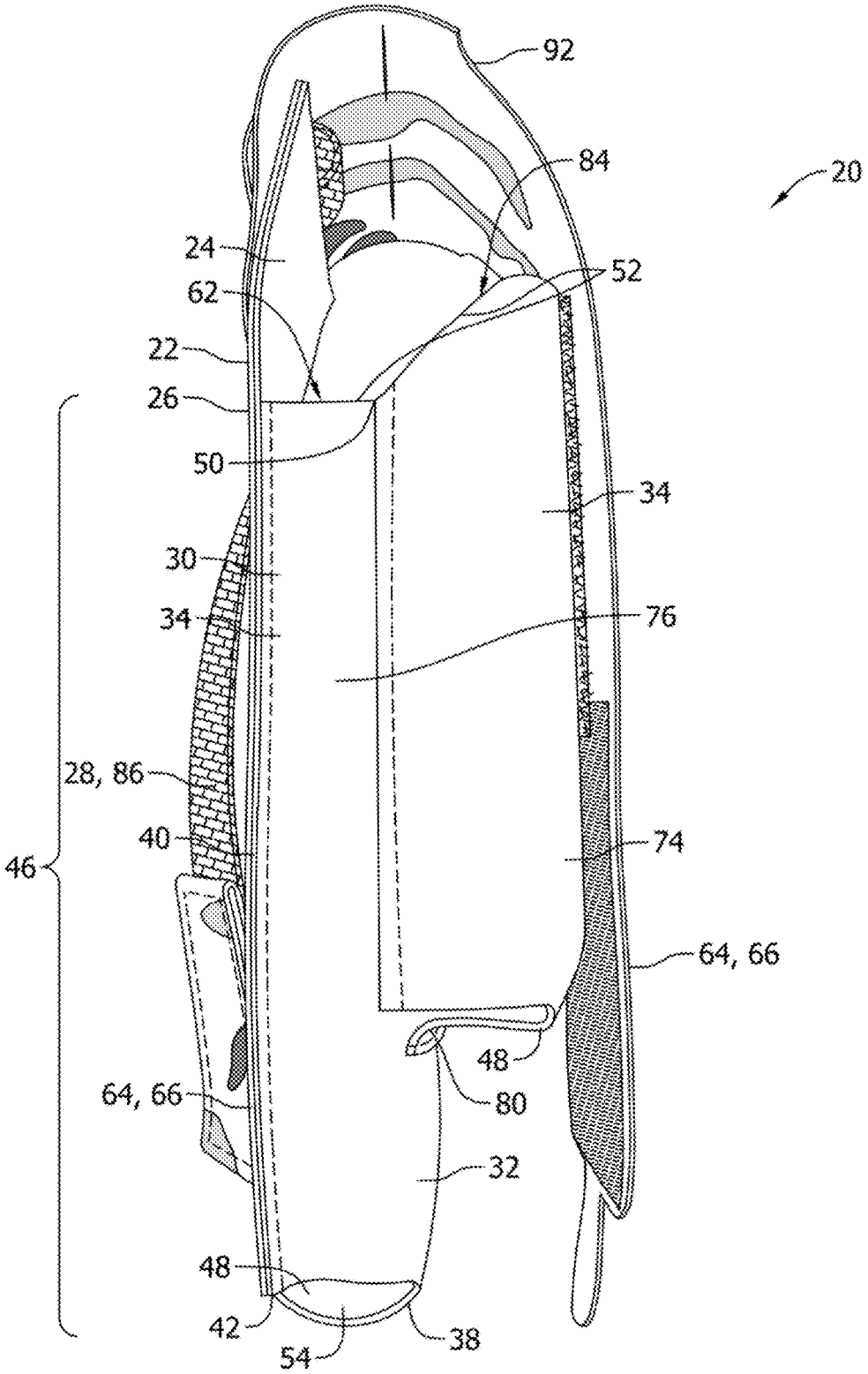
FIG. 3 is a side view of the pouch of FIG. 1.
Figure 4:
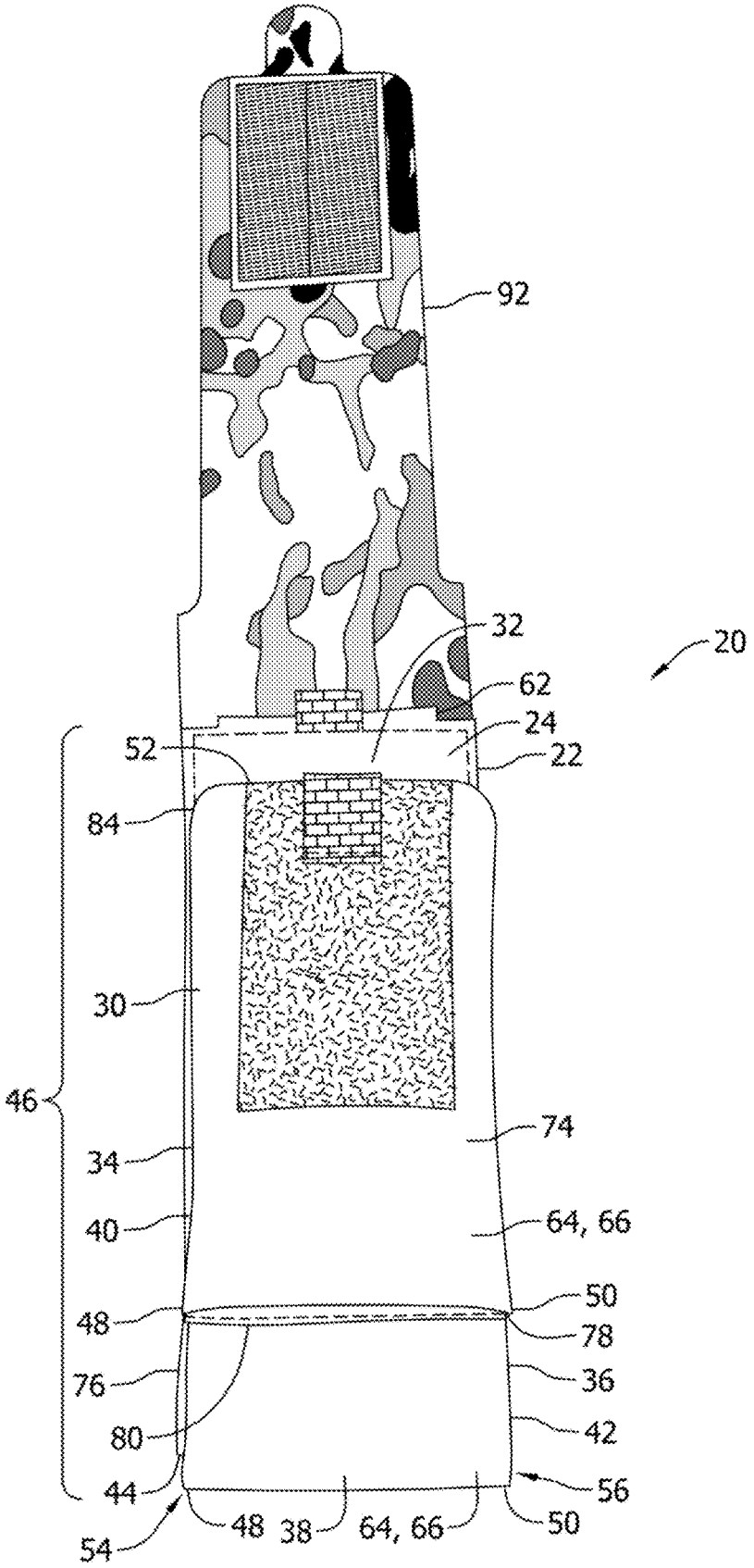
FIG. 4 is a front view of the pouch of FIG. 1, showing the cover in an open position.
Figure 5:
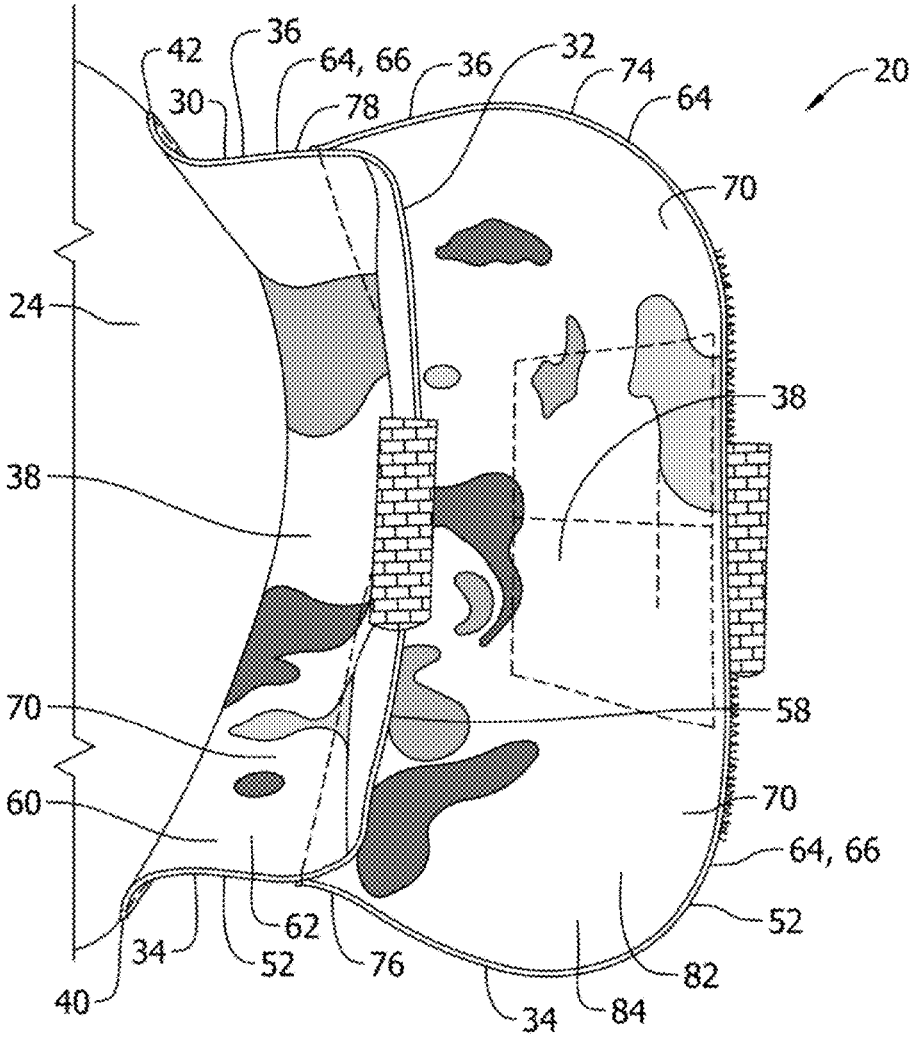
FIG. 5 is a top end view of the pouch of FIG. 1 with the cover removed to show the cavities of the pouch.

Referring to FIGS. 1-7, a preferred embodiment of the invention is shown which is a pouch 20 comprising a platform 22 having a front side 24 and a back side 26 opposite the front side 24. The back side 26 comprises or can receive or connect to at least one attachment element 28 for attaching the pouch 20 to a supporting structure, such as, but not limited to, a garment (not shown) such as a vest, belt, pack, cummerbund, or the like, in a suitable manner, such as by weaving of straps in the manner of the well known MOLLE PALS system or the manners described in U.S. Pat. Nos. 9,565,922 B2, 9,974,379 B2, and 10,281,240 B2, the disclosures of which are incorporated herein in their entireties by reference. The pouch 20 includes a first pouch enclosure panel 30 having a predetermined 3 dimensional shape and comprising a large center region 32 having elongate first, second, and third connector portions 34, 36, 38 along edges thereof integral with and angularly related thereto, connected to first, second, and third peripheral portions 40, 42, and 44 of a pouch region 46 of the front side 24 of the platform 22. Panel 30 has elongate first and second standing portions 48 and 50 at ends 54 and 56 of the connector portions 34, 36, and 38, respectively, essentially in the shape of hairpins—defined as having a center connected end and elongate close together edges, forming standing corners of the pouch 20, and a longer third standing portion 52 supporting a front portion 58 of the pouch enclosure panel 30 in overlaying spaced relation to the pouch region 46 of the front side 24 of the platform 22. Each of standing portions 48, 50, and 52 is sufficiently stiff to have a free standing 2 or 3 dimensional shape. In can thus be observed that center region 32 covers and defines and bounds a pouch cavity 60 encompassing the pouch region 24, and third standing portion 52 and associated front portion 58 define and bound a large opening 62 connected to the cavity 60. It can be also observed that the standing portions 48, 50, and 52 comprise seamlessly integrated edges of the connector portions 34, 36, and 38 of the pouch enclosure panel 30.

Figure 6:
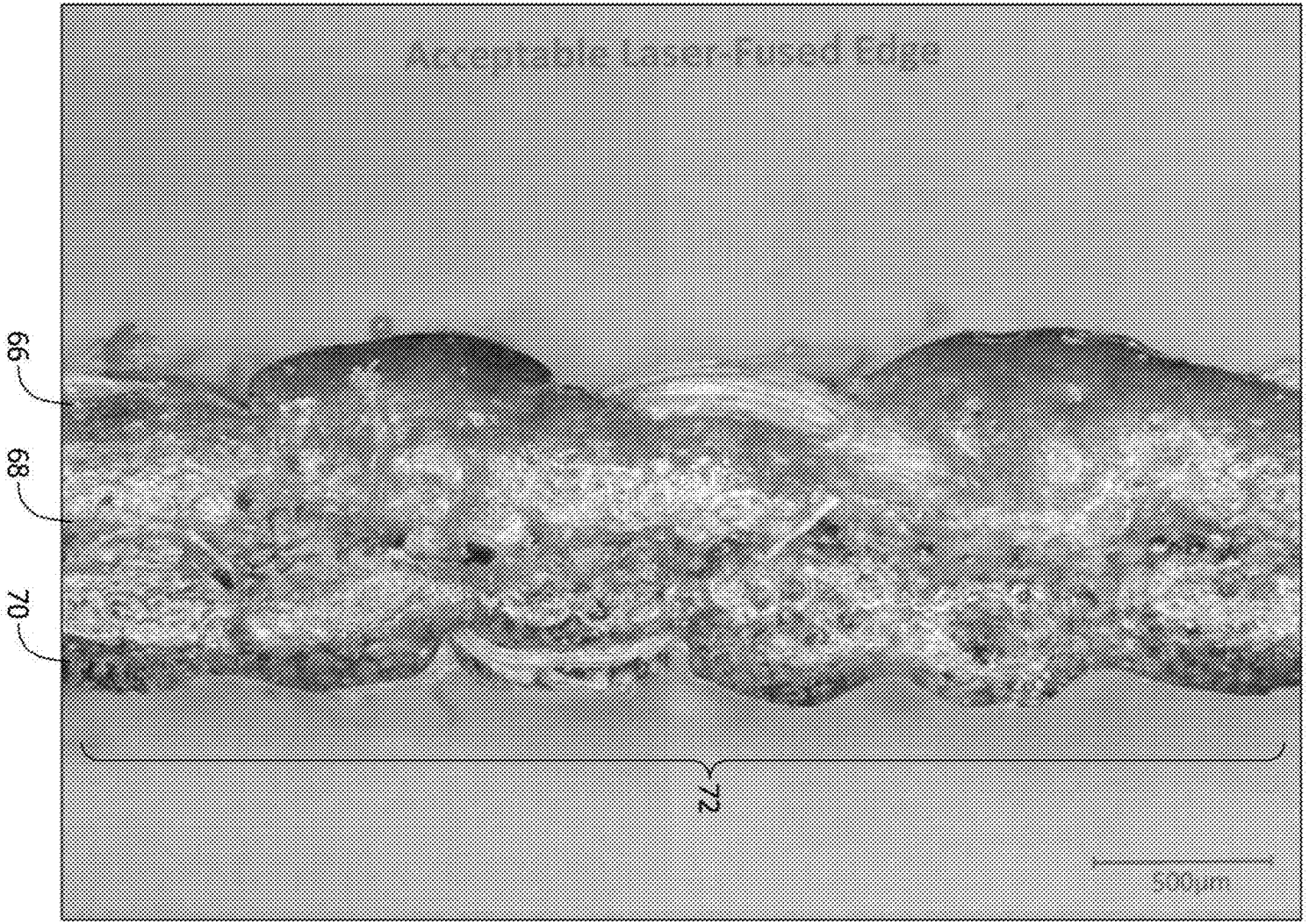
FIG. 6 is a magnified end view of a representative standing portion of the pouch of FIG. 1 comprising stiffened fused together edges of laminated layers.
Figure 7:
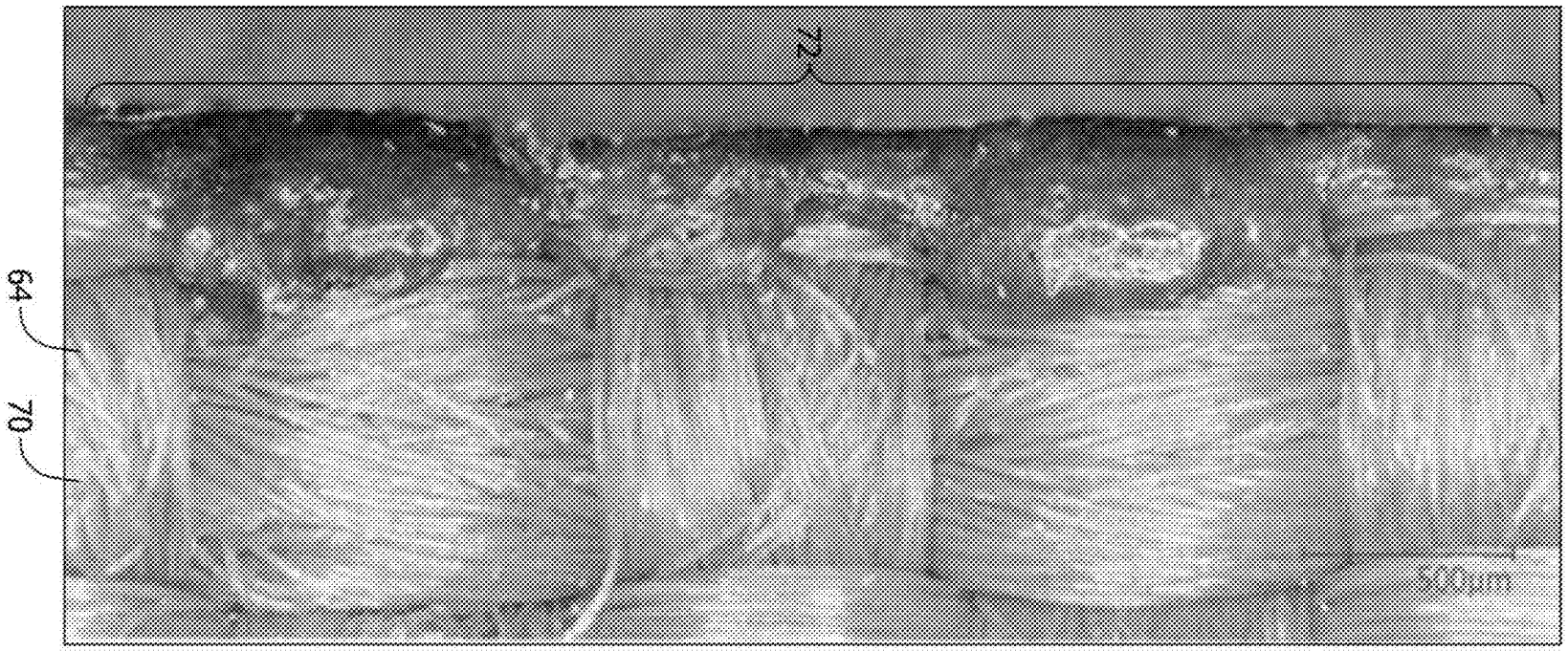
FIG. 7 is a magnified top view of a representative standing portion of the pouch of FIG. 1 comprising stiffened fused together edges of laminated layers.
Figure 8:
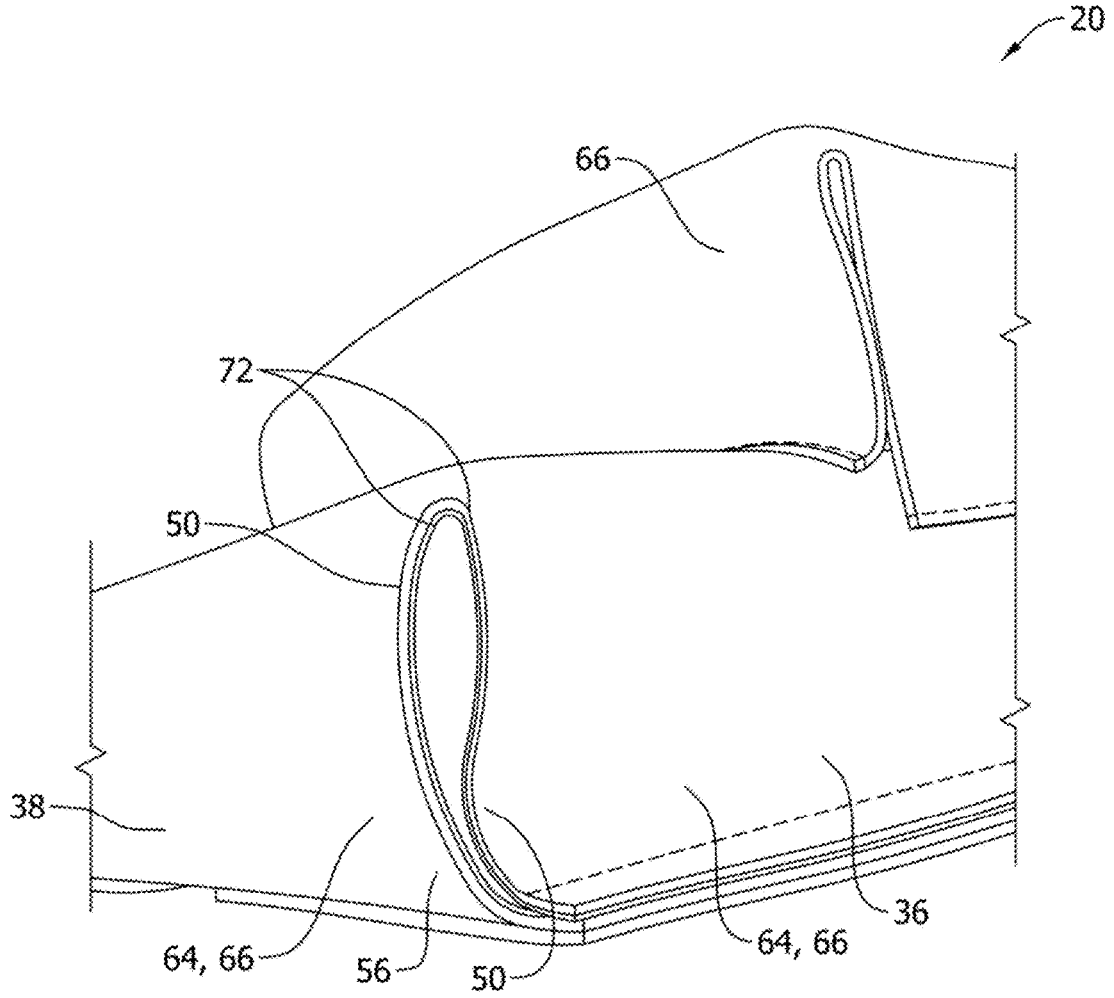
FIG. 8 is an enlarged perspective view of the pouch of FIG. 1, showing a representative standing portion comprising stiffened fused together edges of laminated layers.

Referring more particularly to FIGS. 6-8, as will be explained in detail, the first pouch enclosure panel 30 of this embodiment comprises a laminate 64, which, as a non-limiting example, comprises an outer layer 66, a middle adhesive layer 68, and an inner layer 70, adhesive layer 68 adhering layers 66 and 70 together as is a well known laminating technique. Here however, the standing portions 48, 50, and 52 of the panel 30 comprise stiffened fusions, that is, fused together edges 72 of the laminated layers 66, 68, 70, having sufficient stiffness resulting from the fusing together of the edges, to stand outwardly from platform 22 to hold the first pouch enclosure panel 30 in the 3 dimensional shape.

The pouch 20 is illustrated comprising an optional second pouch enclosure panel 74 having a second predetermined three dimensional shape in spaced, overlaying relation to panel 30, forming a second cavity 82 in essentially stacked relation to cavity 60. Second pouch enclosure panel 74 is of similar construction to panel 30, like parts of the panels 30 and 74 being identified by like numerals. Pouch enclosure panel 74 comprises a center region 32 thereabout having elongate first, second, and third connector portions 34, 36, 38 connected to first, second, and third peripheral portions 76, 78, 80, respectively, about the center region of the first pouch enclosure panel 30. Pouch enclosure panel 74 has elongate first and second standing portions 48 and 50 that comprise integral standing edges of connector portions 34, 36, and 38 thereof, and a third standing portion 52 that comprises a standing edge of a front portion 58 thereof in overlaying spaced relation to the front portion 58 of the first pouch enclosure panel 30, defining and bounding the a second cavity 82 and a second opening 84 that connects to the second cavity 82. The second pouch enclosure panel 74 is also a laminate 64, here again as a non-limiting example, comprising an outer layer 66, an adhesive layer 68, and an inner layer 70. The standing portions 48, 50, and 52 of the second pouch enclosure panel 74 comprise fused together edges 72 of the laminated layers 66, 68, 70 thereof, having sufficient stiffness resulting from the fusion, to stand outwardly from first pouch enclosure panel 30 to hold the second pouch enclosure panel 74 in the second predetermined 3 dimensional shape, with no consequential sagging. In this regard, it can be observed that standing portion 52 of the panel 74 has a substantial 3 dimensional cantilever shape, which is free standing due largely to the enhanced stiffness of standing portion 52 resulting from the fused together edge 72 employed therein.

As is evident, the combination of the laminate 64 and stiffened fused together edges 72 provides a self standing capability for the pouch structures of pouch 20 in its free state, with openings 62 and 84 fully open with no sagging of the pouch enclosure panels so as to interfere with or impede insertion of articles, accessories and other objects into the pouch cavities 60 and 82. No additional reinforcement such as with stiffening panels, basting tape, or the like is required, so that the pouch structure is smooth, lightweight, and easier and simpler to manufacture, and less costly.

As a non-limiting example, the laminate 64 can comprise one or more layers of different fabric materials of nylon and other synthetic fiber materials, plastics film or sheet, e.g., a synthetic rubber compound such as a chloroprene or polychloroprene commercially available from DuPont under the trade name Neoprene, optionally as a laminate. Exemplary materials that can be used providing the desired properties can include, but are not limited to, a woven or knitted nylon fabric; woven or knitted loop fabric; woven or knitted polyester fabric; woven or knitted par-aramid synthetic fiber fabric, e.g., such as commercially available under the trade name Kevlar; woven or knitted ultra-high-molecular-weight polyethylene, e.g., such as commercially available under the trade names Dyneema and Spectra; and non-woven para-aramid nylon, a non-woven polyethylene, or other non-woven composition fabric. The lamination can be accomplished in any suitable manner, such as, but not limited to, using a laminating adhesive such as a curable polyurethane applied from water or hot melt. As another alternative, a single composite fabric having a smooth face for the front surface, and a loop pile or hook component of a hook and loop fastening system for the back surface, can be used. As other suitable composites, one or more layers of a fabric of fiber glass or para-aramid fibers, impregnated with a fusable resin, can be employed.

As noted above, the stiffened fused together edges 72 of the layers of the laminate 64 comprise at least the standing portions 48, 50, 52 of the panels 30 and 74, and optionally additionally can comprise edges of the connector portions 34, 36, and 38 of panels 30 and 74 connected to the associated structure, e.g., in the instance of panel 30, platform 22, and in the instance of panel 74, the periphery of the front of panel 30. Standing portions 52 can be observed as relatively large to span the large openings 62 and 84, and thus have sufficient stiffness for maintaining those openings in the desired shape without sagging when in a free state condition restrained only at the ends. It can be observed in FIG. 5 that panel 30 has an additional internal layer of material affixed thereto, and panel 74 has an additional external layer of material affixed thereto, which additional layers secondarily serve to help the panels hold rectangular shapes along their lengths and breadths, for receiving rectangular items, such as magazines, the interior layer serving primarily to separate the carried items so that they don't inadvertently become engaged so as to be pulled out together when it is desired to remove only one of the items. The external outer layer is observed to comprise a loop pile material that primarily serves as a fastener component of a hook and loop fastener system for attaching an optional cover 92.

Figure 10:
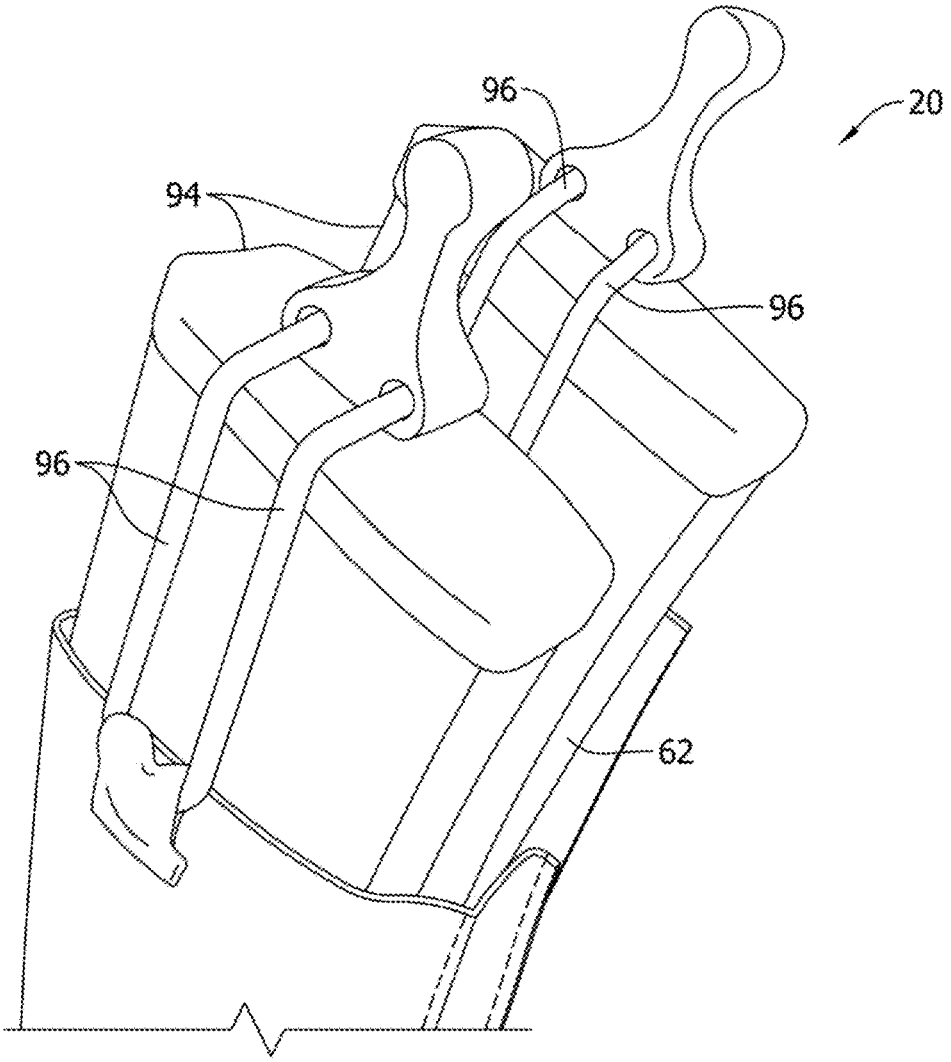
FIG. 10 is a perspective view of another embodiment of the invention, showing optional elastic cords retaining articles which are ammunition magazines, extending from cavities of the pouch.

Additionally, fabric loops are visible that facilitate insertion and separate removal of items, and also serve as attachment points for optional cords 96 (FIG. 10). For additional stiffness, one or more of standing portions 48 and 50 can be observed as having a bowed shape or hairpin shape—with the individual edges having an S-shape, which enhances the overall stiffness at those locations. The connecting portions can be observed connecting to their associated base structure, using single lines of stitching along the lengths thereof, which holds the shapes of the standing portions 48 and 50, and which also serves to secure the ends of standing portions 52 in their extended bowed, arched shapes. Alternatively, various mechanical fasteners, such as, but not limited to, rivets, staples, or adhesives, can be used for affixing the connector portions to their associated base structures.

The fused together edges 72 of the laminated layers can be produced in a suitable manner that directs sufficient energy against the laminate to achieve melting together of the materials of preferably at least the inner and outer layers, to achieve cohesive fusion of the edges themselves, not just between the layers as is achieved by laminating alone. Often, the materials of the different layers will have different melting temperatures or other characteristics, and the selection of at least the inner and outer layers of the laminate should take this into consideration. For instance, some adhesives such as pressure activated and thermal activated adhesives commonly used for laminating can have a lower melting temperature than materials of layers being laminated and may even burn or vaporize when subjected to temperatures necessary for achieving desired melting of the other layers. In this instance, a manner of melting the other layers so as to fuse together should be implemented. Charred residue from a burned adhesive or other layer can be advantageous when captured or entrained in the fusion for imparting added hardness and wear resistance. If lower melting point fibers or filaments are employed in any of the layers, the remaining ends of those can be entrained in the fusion of the other materials.

Laser fusion is a preferred manner of achieving desired fused together edges of a variety of laminates, such as, but not limited, nylon fabric laminates. Type of laser, power, duty cycle, focal length, and beam width, travel speed and other parameters are highly adjustable and it has been found that there are ranges of settings that can be employed to achieve acceptable fusion together of laminate layers with requisite resulting stiffness, hardness, and resiliency, while also accurately cutting the laminate at the same time to predetermined dimensions and shapes.

A representative stiffened fused together edge 72 of laminated nylon fabric materials achieved using a laser fusion process suitable for the pouch 20, is shown in FIGS. 6 and 7. The subject layers of the laminate 64 fused to create edge 72 shown include an outer layer 66 of a woven nylon fabric; a laminating adhesive layer 68, and an inner layer 70 of a woven nylon. The nylon weaves can be of the same or different deniers, e.g., 400, 500, 725, 1000 deniers, and can have different finishes. The illustrated example is also representative of other laminates that can be employed, such as a nylon woven fabric and a nylon non-woven pile fabric, such as, but not limited to, those commonly used as a component of a hook and loop fastening system. Alternatively or additionally, the laminate can comprise one or more layers of an aramid fiber composition to provide a ballistic protective capability. It is evident from the images that the fusion of the laminated layers is sufficiently comprehensive so as to encompass essentially the entire edge of the laminated layers 66, 68, and 70 and integrates with the laminate permanently and essentially seamlessly with no significant protruding edges filaments, or other potential obstructions or collection points for contaminants such as dirt, sand, dust, etc. The laser fusion parameters are preferably selected also so that the resulting fused edges 72 are sufficiently manually resiliently flexible to allow forming the pouch enclosure panel into the desired 3 dimensional shape or shapes, and in combination with the laminated construction of the associated panel, to substantially retain the panel in the 3 dimensional shape while the pouch is in a free state, that is, not subject to external loads other than gravity, while being collapsible under applied loads such as hand pressure, with the pouch returning to the free state shape when the applied load is removed. The comprehensive fusion is desirably durable, and wear resistant such that the peripheral edge will not fray significantly under expected use. The fused edges 72 are also preferably hardened by the fusion process so as to have increased wear resistant and other advantageous properties. At least the stiffened standing portions 52 can optionally have sufficient resilient elasticity to allow the pouch enclosure panel to be capable of easily receiving yet conforming and snugging about anticipated items to extend through the openings 62 and 84 and be held in the pouch, see the example ammunition magazines in FIG. 2. In this latter regard, at least the standing portions 52 bounding the openings 62 and 84 can be restrained at their ends to the associated support structure, e.g., platform 22, panel 30, and essentially resiliently bento or bowed into an arch shape as shown, which along with tight dimensional control, allows the standing portion to conform around an item extending through the associated opening 62 or 84. The possible shapes of panels 30 and 74 can include, but are not limited to, rectangular, square, and other polygons, rounded, oval, and the like. The panels 30 and 74 can also be formed so as to have a particular free state shape, such as an arch shape, hoop, rounded or oval shape, rectangular or other polygonal shape, by fusion of the one or more of the edges of the laminate with the panel held in the desired shape, for instance, around a mandrel having the shape.

Figure 9:
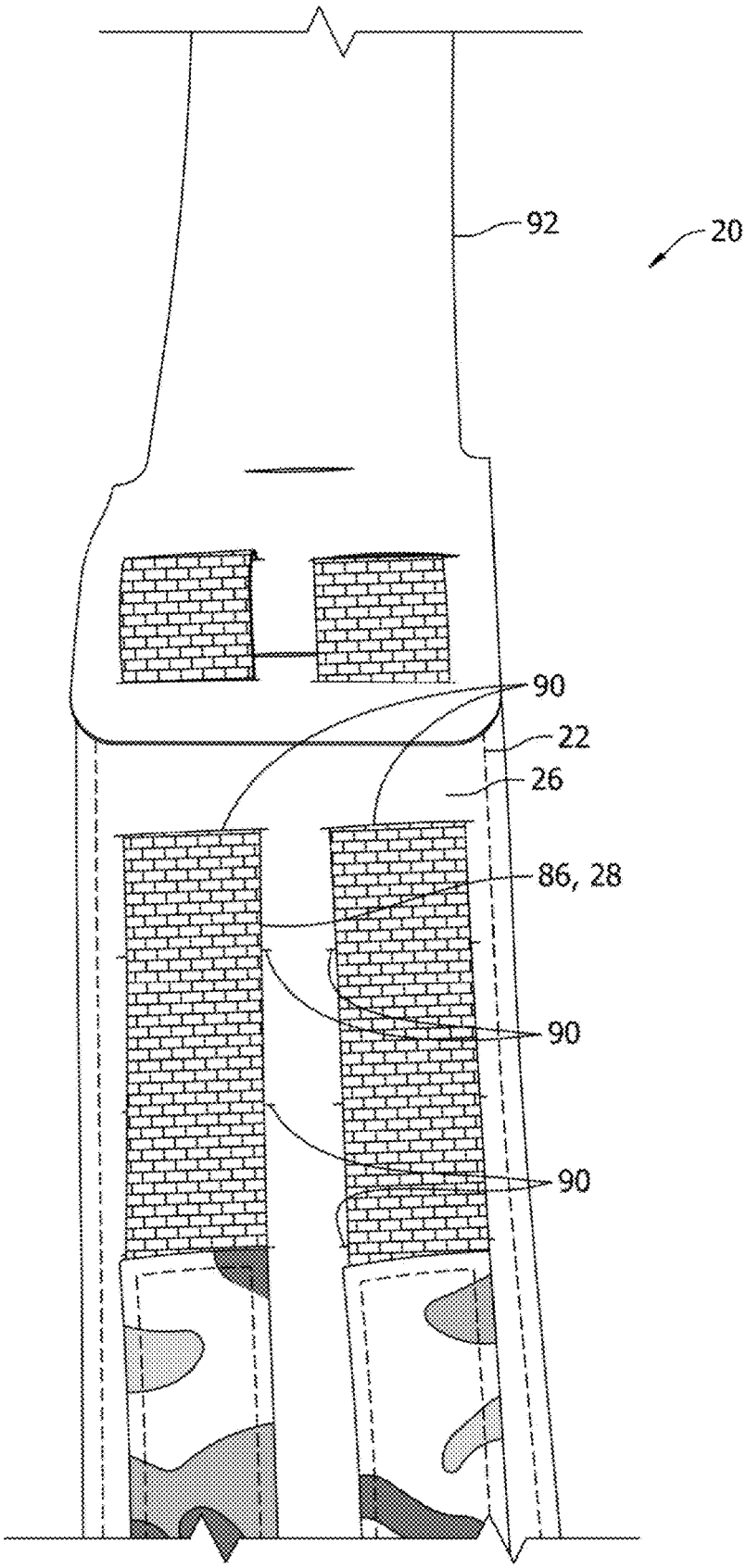
FIG. 9 is a rear view of the pouch of FIG. 1, showing attachment elements associated with a back side of a platform of the pouch.

As mentioned above, the platform 22 has appropriate elements for attaching or mounting to a garment or other structure, for instance, but not limited to, in the manner of conventional MOLLE PALS systems, using a strap or straps that can be woven through slits 90 on back side 26, see FIG. 9, and associated slits or bands on the garment or other structure, in the well known manner. This can include fasteners such as snaps, hook and loop, or tuck tabs (shown) as non-limiting examples. As advantages, this makes the pouch backwards compatible with existing MOLLE platforms.

It is anticipated that the pouch 20 will include an additional closure or restraint(s) for items carried in cavities 60 and 82 and potentially extending from the associated openings 62, 84. As representative examples, a cover 92 is shown attached via weaving with straps 86 to pouch 20 in FIGS. 1, 3, 4 and 9, and closed using the outer loop pile on pouch enclosure panel 74, for restraining items such as magazines 94 shown in FIG. 2. FIG. 10 shows alternative attachment of elastic cords 96 to the pouch 20 at suitable locations, e.g., fabric loops, for restraining items, e.g., magazines 94. The magazines can be separately restrained by their own cords, or jointly restrained as desired. Cover 92 can be of the same or different construction as the pouch enclosure panels 30 and 74, that is, for example, of the laminate 64 having a standing portion 52 peripherally thereabout to provide a resilient capability to bend or bow into an arch or other suitable shape as shown in covering relation to the carried article or articles. As another alternative, the openings 62 and 84 can have separate associated covers 92 to restrain the items separately.

In light of all the foregoing, it should thus be apparent to those skilled in the art that there has been shown and described a novel 3 dimensional shape retaining light weight pouch and method for making the same for carriers such as vests, belts, and the like. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A pouch, comprising:

a platform having a pouch region bounded by peripheral portions;

a pouch enclosure panel comprising laminated layers of material with a peripheral edge at least partially thereabout comprising peripheral connector portions having edge portions overlaying and connected to the peripheral portions of the platform, respectively, bounding a pouch enclosure region of the pouch enclosure panel, the pouch enclosure panel comprising standing portions comprising ends of the connector portions, respectively, supporting the first pouch enclosure panel in overlaying spaced relation to the pouch region of the platform defining and bounding a cavity therebetween and an opening connected to the cavity; and the edge portions of the connector portions overlaying and connected to the peripheral portions of the platform structure comprising edges of the laminated layers fused together to have increased wear resistance with sufficient resilient elasticity to allow the pouch enclosure panel to be capable of conforming about an item extending through the opening connected to the cavity.

2. The pouch of claim 1, wherein the laminated layers comprise fabric layers laminated together by an adhesive layer therebetween.

3. The pouch of claim 2, wherein each of the fused together edges of the laminated layers comprise fusion of the fabric layers and the adhesive layer therebetween.

4. The pouch of claim 1, wherein at least one of the laminated layers comprises a synthetic rubber compound.

5. The pouch of claim 1, wherein at least one of the laminated layers comprises para-aramid fibers.

6. The pouch of claim 1, wherein the edges of the laminated layers are laser fused.

7. The pouch of claim 1, wherein some of the standing portions have a hairpin shape.

8. The pouch of claim 1, wherein at least some of the standing portions have an S-shape.

9. The pouch of claim 1, comprising a second pouch enclosure panel connected in overlaying relation to pouch enclosure panel defining and bounding a second cavity therebetween and a second opening connected to the second cavity.

10. The pouch of claim 1, wherein the platform comprises a back side having at least one attachment element for attaching to a support structure.

11. The pouch of claim 1, wherein at least some of the standing portions comprise stiffened fusions of edges of the laminated layers.

12. A pouch, comprising:

a platform;

a first pouch enclosure panel comprising a periphery thereabout having connector portions connected to peripheral portions of a pouch region of the platform, and standing portions angularly related to the connector portions, respectively, and disposed therebetween, the first pouch enclosure panel comprising a composite material, the standing portions comprising edges of constituent components of the composite material, extending outwardly from the platform and fused together so as to be hardened to have increased wear resistance, the first pouch enclosure panel having a three dimensional shape in overlaying spaced relation to the pouch region of the platform to define and bound a cavity therebetween and an opening connected to the cavity.

13. The pouch of claim 12, wherein the composite material comprises a fabric.

14. The pouch of claim 12, wherein the composite material comprises one or more layers of a fabric of fiber glass or para-aramid fibers, impregnated with a fusable resin.

15. The pouch of claim 12, wherein the connector portions connected to the peripheral portions of the pouch region of the platform comprise stiffened fused together edges of constituent components of the composite material.

16. The pouch of claim 12, wherein the fused together edges of the constituent components of the composite material are laser fused.

17. The pouch of claim 12, wherein the opening has a 3 dimensional shape.

18. The pouch of claim 12, comprising a second pouch enclosure panel having a second predetermined three dimensional shape and a periphery thereabout having connector portions connected to peripheral portions of the first pouch enclosure panel, and second standing portions angularly related to and extending out from the connector portions of the second pouch enclosure panel, supporting the second pouch enclosure panel in overlaying spaced relation to the first pouch enclosure panel, defining and bounding a second cavity therebetween and a second opening connected to the second cavity.

19. The pouch of claim 12, wherein the platform comprises at least one attachment element for attaching the pouch to a supporting structure.

20. The pouch of claim 19, wherein the at least one attachment element comprises a plurality of slits through a back side of the platform opposite the first enclosure panel.

21. A pouch, comprising:

a pouch enclosure panel comprising laminated fabric layers, resiliently retained in a 3 dimensional shape defining and bounding a cavity, the pouch enclosure panel further comprising a plurality of pairs of side by side standing portions comprising edges of the laminated fabric layers, respectively, bounding openings connected to the cavity and fused together to be hardened to have increased wear resistance.

22. The pouch of claim 21, wherein the 3 dimensional shape comprises a rectangular shape.

23. The pouch of claim 21, wherein the pouch comprises at least one attachment element for attaching the pouch to a supporting structure.

* * * * *